United States Patent [19]

Petrillo

[11] Patent Number: 4,981,299

[45] Date of Patent: Jan. 1, 1991

[54] ELECTRO-MECHANICAL TEEING APPARATUS FOR GOLF BALLS

[76] Inventor: Michael J. Petrillo, 196 Ellison St., Rochester, N.Y. 14609

[21] Appl. No.: 444,321

[22] Filed: Dec. 1, 1989

[51] Int. Cl.[5] ..... A63B 57/00

[52] U.S. Cl. ..... 273/201

[58] Field of Search ..... 273/201, 202, 184 R, 273/35 R, 35 B, 197 R, 197 A

[56] References Cited

U.S. PATENT DOCUMENTS

| | | | |
|---|---|---|---|
| 2,212,877 | 8/1940 | Gale | 273/201 |
| 2,235,280 | 11/1943 | Hogeberg | 273/201 |
| 3,423,097 | 1/1969 | Fry | 273/201 |
| 3,778,067 | 12/1973 | Gentiluomo | 273/201 |
| 3,941,446 | 7/1983 | Elberle | 273/201 |
| 4,602,789 | 7/1986 | Chung | 273/201 |

*Primary Examiner*—Theatrice Brown

*Attorney, Agent, or Firm*—Robert J. Bird

[57] ABSTRACT

An automatic apparatus for teeing golf balls for practice hitting includes a ball container, an indexer rocker wheel, a ball positioner, and a tee. The indexer rocker wheel carries a ball from an intake position at the container to a discharge position over the ball positioner, and returns for another ball. The ball positioner includes a reversible drive motor and a ball carrier for movement back and forth between a ball pickup position at the indexer to a ball delivery position on the tee. The tubular tee includes a photosensor operatively connected to the drive motor and responsive to light to signal the operation of the ball positioner.

1 Claim, 3 Drawing Sheets

MOTOR
SENSE
CONTROL
TEE
SENSE
SENSOR
MOTOR DRIVER CIRCUIT
MICRO-PROCESSOR
D.C.
50/150 V.
CONTROL
SENSE
5 V.D.C.
MOTOR POWER SUPPLY
LOGIC POWER SUPPLY
60Hz. 115 V. A.C.
60
61
62
63
64

10
20
21
23
24
25
30
31
32
33
34
35
36
40
41
42
43
44
48
49
50
51
2
3

ELECTRO-MECHANICAL TEEING APPARATUS FOR GOLF BALLS

FIELD OF THE INVENTION

The subject matter of this invention is an electromechanical teeing apparatus to place golf balls, one after another, on a tee for practice or instructional hitting.

BACKGROUND INFORMATION

It is the common practice at golf driving ranges to provide the practice golfer with golf balls by the bucketful for practice hitting to improve the golfer's swing, stance, grip, and so forth. After hitting the ball from the tee, the golfer must move from his stance to the bucket, stoop over and take a new ball from the bucket, move to the tee, place the ball on the tee, then straigten up and resume his stance for hitting the new ball.

The present invention provides a considerable improvement on this procedure. It obviates the need to abandon one's grip and stance and go through all the motions, particularly the stooping motion, necessary to replace a ball on the tee after every stroke. The automated teeing apparatus of this invention is of particular value to golf instructors and their pupils. The instructor's function is to observe subtle errors in the grip, stance, swing, or some other aspect of the pupil's performance and to show the pupil how to correct them. The present need to remove the grip and move from the stance to place a new ball on the tee interrupts the continuity of this procedure. The pupil's initial (perhaps incorrect) grip and stance, which are the conditions of reference for corrective instruction, is perforce lost. The apparatus of this invention eliminates the necessity of manual ball replacement and therefore makes instruction more efficient and effective.

The practice golfer using this apparatus without an instructor, i.e. at a driving range, will enjoy the same benefit and will be enabled to more effectively experiment with grip, stance, and swing, and to make appropriate adjustments of the same. In addition, the apparatus prevents or decreases fatigue, and therefore simply makes the driving range easier and more convenient to use.

SUMMARY OF THE INVENTION

The present invention is an automatic apparatus for teeing golf balls for practice hitting. It includes a ball container, an indexer rocker wheel, a ball positioner, and a tee. The indexer rocker wheel carries a ball from an intake position at the container to a discharge position over the ball positioner, and returns for another ball. The ball positioner includes a reversible drive motor and a ball carrier for movement back and forth between a ball pickup position at the indexer to a ball delivery position on the tee. The tubular tee includes a photosensor operatively connected to the drive motor and responsive to light to signal the operation of the ball positioner.

DETAILED DESCRIPTION

Figures 1, 4:
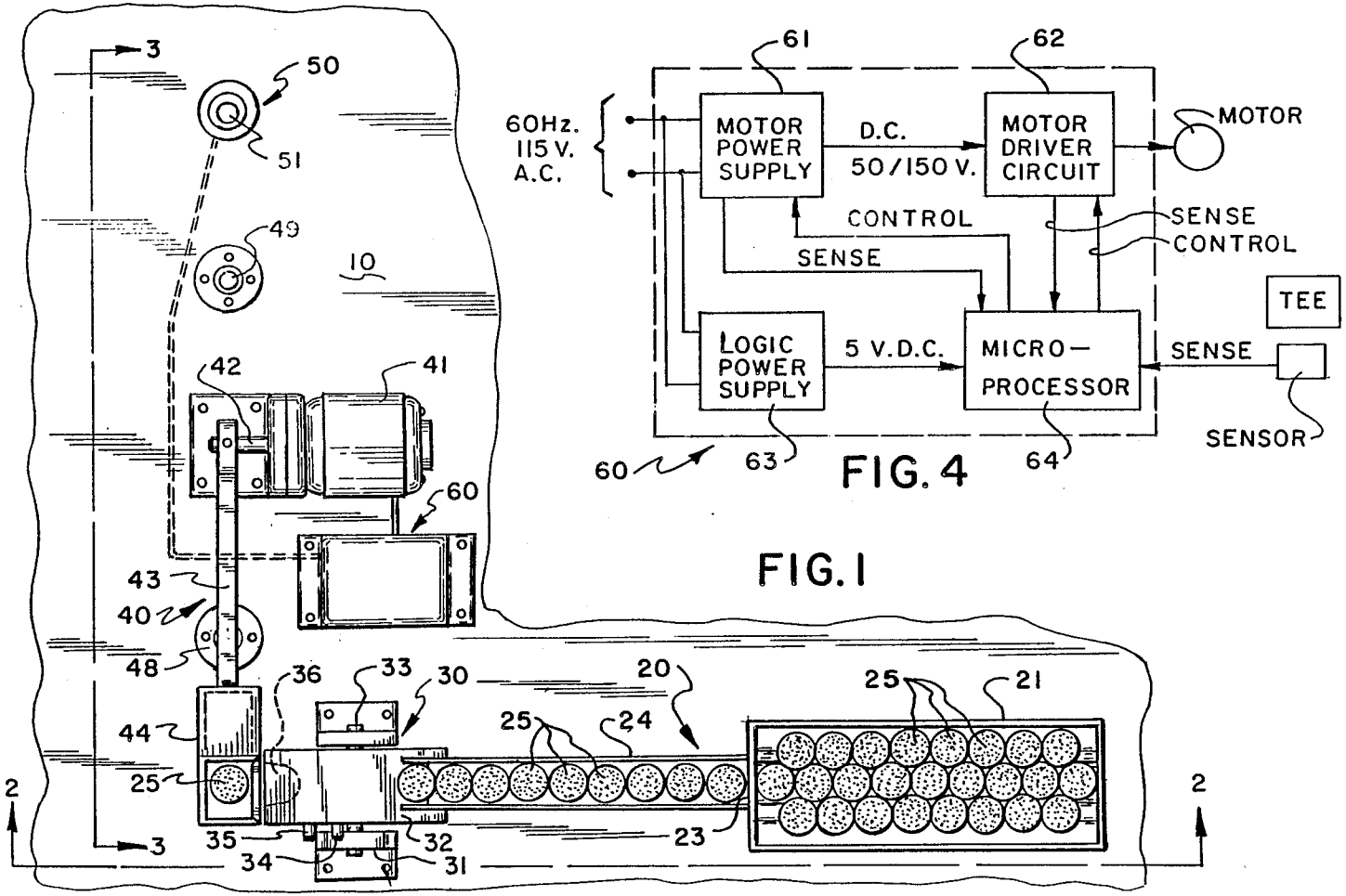
FIG. 1 is a top plan view of a ball teeing apparatus of this invention.
FIG. 4 is a block diagram of the control system for the apparatus.
Figure 2:
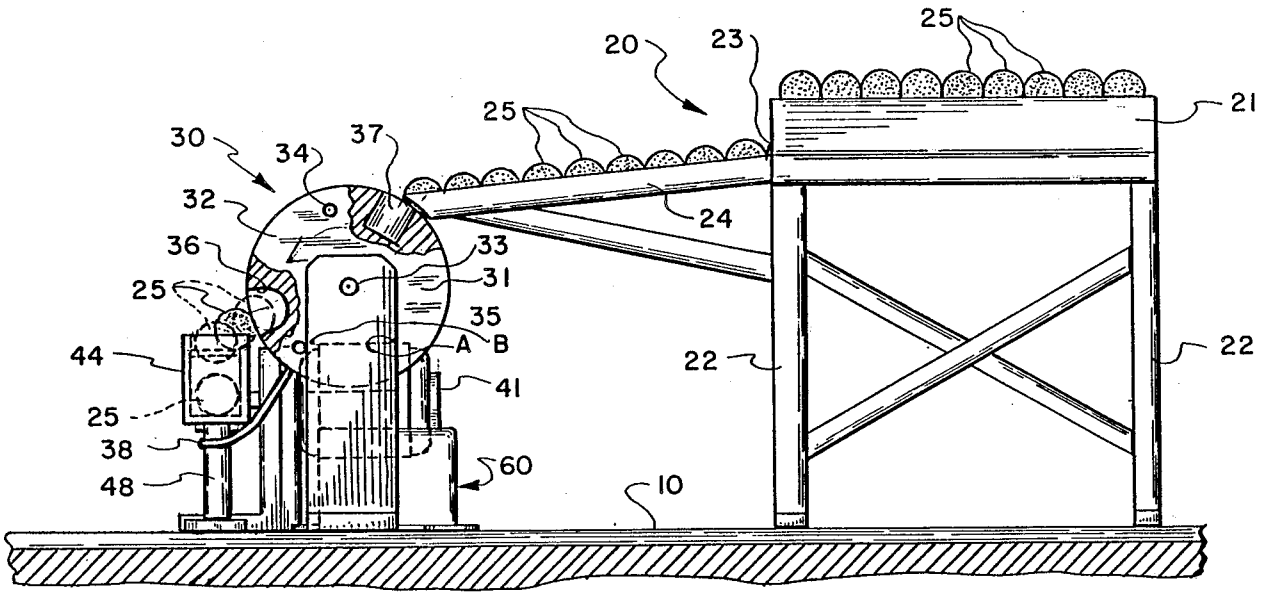
FIG. 2 is an elevation view, as in the direction 2—2 of FIG. 1.
Figure 3:
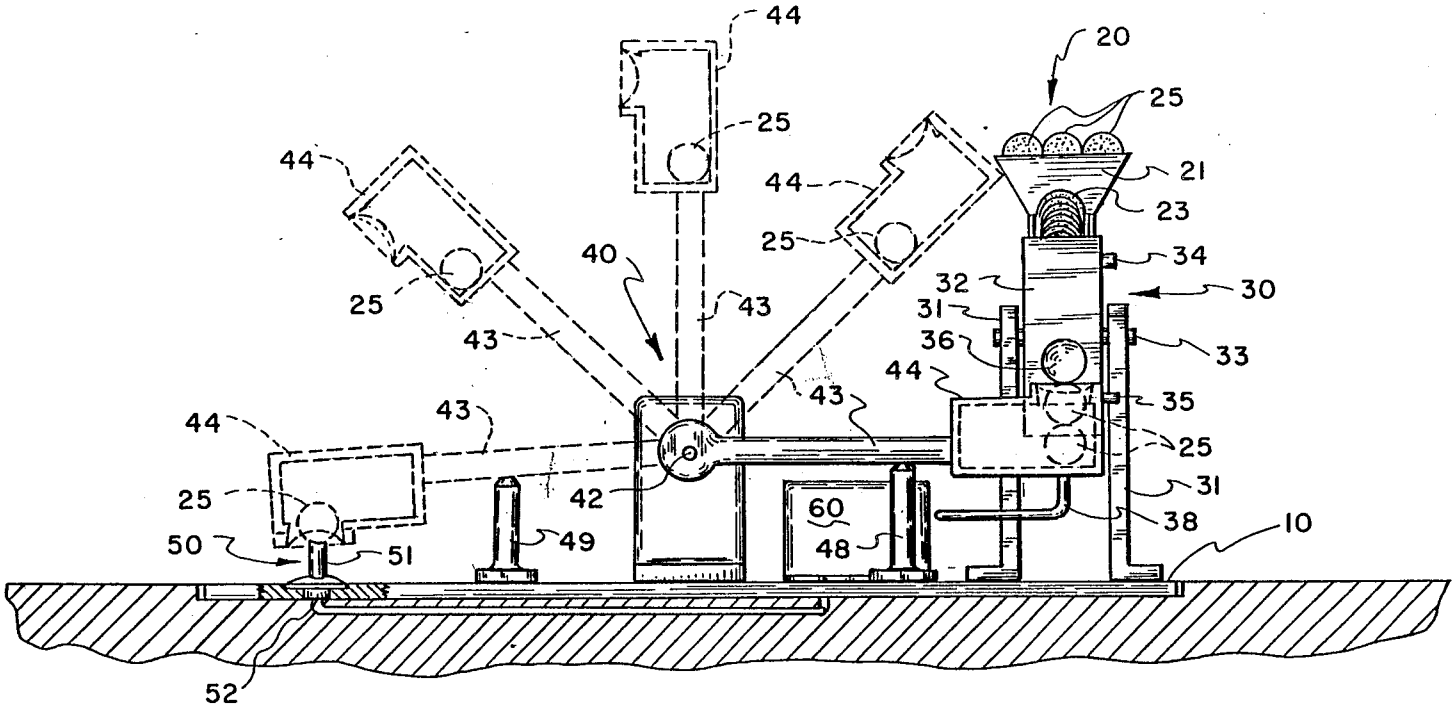
FIG. 3 is an elevation view, as in the direction 3—3 of FIG. 1.

With reference now to FIGS. 1–3, the electromechanical teeing apparatus of this invention includes a ball supply 20, a ball indexer 30, a ball positioner 40, a golf tee 50, and electronic controls 60. These are all arranged and mounted on a flat support plate 10 for placement on the ground. The apparatus may or may not be portable.

The ball supply 20 (see especially FIGS. 1 and 2) includes an open-top ball container 21 mounted on legs 22 at an elevation relative to the ball indexer 30. The ball container 21 includes a side opening 23. A ball track or channel 24 is mounted to the ball container 21 and extends at a downward incline from the opening 23 to the ball indexer 30. The ball container 21 holds a supply of golf balls 25.

The ball indexer 30 (see especially FIG. 2) includes a wheel mount 31. A rocker wheel 32 is rotatably mounted on the mount 31 by means of a rocker shaft 33. The rocker wheel 32 includes a pair of axially extending stop pins 34 and 35 to abut the mount 31 at stop positions A and B, respectively. These stops limit the rotation of the wheel to a rocking movement of approximately 90°–110° between stops. Stop pin 34 is the "intake" stop pin, and it abuts the wheel mount 31 at point A to stop the rocker wheel 32 at its ball intake position. Stop pin 35 is the "discharge" stop pin, and it abuts the wheel mount 31 at point B to stop the rocker wheel 32 at its ball discharge position, as shown. The rocker wheel 32 further includes, at its periphery, a ball cavity 36, an insert weight 37, and a radial arm 38. The ball cavity 36 is sized and configured to hold one ball as the wheel 32 turns from its intake position to its discharge position.

The ball positioner 40 (see especially FIGS. 1 and 3) includes a drive motor 41 which is operatively connected to a drive shaft 42. The drive shaft 42 is fixed at a right angle to the inner end of a ball transfer arm 43 which includes a ball carrier receptacle 44 fixed at its outer end. The transfer arm 43 is movable through an arc of approximately 180°, back and forth, to move the ball carrier 44 from a ball pickup position (solid lines in FIG. 3) at the rocker wheel 32, to a ball delivery position at the tee 50. At the ball pickup position, the transfer arm 43 abuts on a pickup stop 48. At the ball delivery position, the arm 43 abuts on a delivery stop 49. The stops 48 and 49 provide physical limits to the arcuate travel of the transfer arm 43. The stops may be padded to protect the arm 43 and other members from shock loading. The motor 41 is a reversible electric motor, such as a DC gearmotor for example.

The tee 50 (FIGS. 1 and 3) includes a hollow flexible tube 51 to support a golf ball 25. A photosensor 52 beneath the tee and on the axis of the tube 51 is operatively connected to the control unit 60.

FIG. 4 is a block diagram of the control system 60. The controls include a motor power supply 61, a motor driver circuit 62, a logic power supply 63, and a microprocessor 64. The control system 60 is operatively connected to the drive motor 41, to the photosensor 52, and to a suitable power source.

The motor controller includes a high voltage (50 to 150 volts) motor driver section, and a low voltage (5 volts) microprocessor section. The microprocessor monitors and controls the direction, torque, and speed of the drive motor 41 by means of the optically isolated photosensor 52. The microprocessor receives signals from the photosensor 52 under the tee 50 to thereby determine continually the presence or absence of a ball on the tee. The microprocessor continually monitors the tee photosensor 52, and directs the movement of the transfer arm 43 and ball carrier 44 when a new ball is needed on the tee.

The system operates, whenever the tee does not have a ball upon it, to place a golf ball on the tee. This is accomplished by the following cycle: (1) detecting the absence of a ball on the tee; (2) moving the transfer arm 43 and ball carrier 44 over the tee 50 to deposit a replacement ball on the tee; (3) returning the transfer arm 43 and carrier 44 to the ball pickup position; and (4) loading a replacement ball into the carrier 44 of the transfer arm 43 to await the next signal of step 1.

A more detailed description of the operation is as follows: As a starting point, consider the system at rest and with a ball on the tee. The ball carrier 44 is in its ball pickup position where it has received a ball from the rocker wheel 32 (solid line condition of FIG. 3). The ball carrier 44 holds down the radial arm 38 to keep the rocker wheel 32 in its ball discharge position. The photosensor 52 beneath the tee is receiving no light and the system remains at rest. The radial arm 38 is of a compound curved configuration (see both FIGS. 2 and 3) so as to be in the path of the ball carrier at all times.

When the ball is hit or removed from the tee, the photosensor detects light, i.e. the absence of a ball. This signals the operation of the motor 41 to move the transfer arm 43 and ball carrier 44 over the tee 50 to deposit a replacement ball on the tee. The transfer arm 43 abuts the delivery stop 49 with the arm 43 slightly below horizontal so that the ball 25 rolls out of the ball carrier 44 and onto the tee 50. The microprocessor reverses the motor, returning the transfer arm 43 and carrier 44 to the ball pickup position at the rocker wheel. While the transfer arm has been delivering the replacement ball, the rocker wheel has been released and returned by means of the weight 37 to its ball intake position to receive a new ball from the ball track 24. The returning transfer arm now pushes down the radial arm 38, rotating the rocker wheel 32 into its discharge position, and abuts against the pickup stop 48. The new ball enters the ball carrier 44 from the rocker wheel 32. At this position of the transfer arm 43, the microprocessor reverses the polarity of the motor drive circuit. The system is now again at rest, awaiting the next start signal.

It is contemplated that the teeing apparatus of this invention might be coin-operated.

The foregoing description of a preferred embodiment of this invention is intended as illustrative. The concept and scope of the invention are limited only by the following claims and equivalents thereof.

What is claimed is:

1. Apparatus for teeing golf balls for practice hitting, including:

a ball container a ball indexer including a rotatable rocker wheel with a ball cavity on the periphery thereof and adapted for rocking movement from a ball intake position at said container to a ball discharge position, and from said ball discharge position back to said ball intake position;

a ball positioner including a reversible drive motor and a ball carrier operatively connected to said drive motor for movement back and forth between a ball pickup position at said ball indexer and a ball delivery position, said ball positioner further including pickup and delivery stops corresponding to the pickup and delivery positions of said ball carrier; and a tee including a tube to support a golf ball at said ball delivery position, and a photosensor disposed under said tube on the axis thereof and operatively connected to said drive motor, said photosensor being responsive to the incidence of light thereon to signal the operation of said ball positioner.

* * * * *